US011827321B2

(12) United States Patent
Skrydstrup

(10) Patent No.: US 11,827,321 B2
(45) **Date of Patent: *Nov. 28, 2023**

(54) FOLDING PROPELLER

(71) Applicant: Flexofold ApS, Egtved (DK)

(72) Inventor: Jack Skrydstrup, Egtved (DK)

(73) Assignee: FLEXOFOLD APS, Vejle (DK)

( * ) Notice: Subject to any disclaimer, the term of this patent is extended or adjusted under 35 U.S.C. 154(b) by 1225 days.

This patent is subject to a terminal disclaimer.

(21) Appl. No.: 15/999,487

(22) PCT Filed: Sep. 7, 2016

(86) PCT No.: PCT/DK2016/050294
§ 371 (c)(1),
(2) Date: Aug. 20, 2018

(87) PCT Pub. No.: WO2017/140314
PCT Pub. Date: Aug. 24, 2017

(65) Prior Publication Data

US 2021/0206462 A1 Jul. 8, 2021

(30) Foreign Application Priority Data

Feb. 18, 2016 (DK) ..... PA 2016 70089

(51) Int. Cl.
*B63H 1/24* (2006.01)

(52) U.S. Cl.
CPC ..... *B63H 1/24* (2013.01)

(58) Field of Classification Search
CPC ..... B63H 1/20; B63H 1/22; B63H 1/24
USPC ..... 440/49, 79; 416/142
See application file for complete search history.

(56) References Cited

U.S. PATENT DOCUMENTS 3,981,613 A * 9/1976 Ehrenskjold ..... B63H 1/24 416/241 A
4,290,760 A * 9/1981 Lindblad ..... B63H 25/42 440/51
4,768,927 A * 9/1988 Munk ..... B63H 1/24 416/212 R (Continued)

FOREIGN PATENT DOCUMENTS

DK 178074 B1 4/2015
WO 9106468 A1 5/1991

(Continued)

*Primary Examiner* — Daniel V Venne
(74) *Attorney, Agent, or Firm* — Cermak Nakajima & McGowan LLP; James Creighton Wray

(57) ABSTRACT

The present invention discloses a folding propeller (1) for a boat, e.g. for a sailboat or a multihull yacht, where said folding propeller (1) comprises a hub (2) for directly or indirectly fastening at a driveshaft connected to a motor, where said folding propeller (1) further comprises at least three individual blades (3), where each of said blades (3) comprises a blade root (4) arranged to pivot around a separate pivot pin (9), at said hub (2) in order to be either in a first and operative position, where the blade (3) is pointing mainly in a radial direction, or in a second and inoperative position, where the blade (3) is pointing mainly in an axial direction, where said pivot pin (9) comprises a first and second end (20, 21), where said hub (2) comprises a cut out (19) for each of said blade roots (4), and further comprises a set of holes (10) for installing said pivot pins (9).

13 Claims, 7 Drawing Sheets

(56) References Cited

U.S. PATENT DOCUMENTS

| | | | | |
|---|---|---|---|---|
| 5,183,384 | A | 2/1993 | Trumbly | |
| 5,403,217 | A | 4/1995 | Vosper | |
| 10,214,269 | B2 * | 2/2019 | Skrydstrup | B63H 1/22 |
| 10,793,243 | B2 * | 10/2020 | Skrydstrup | B63H 1/22 |

FOREIGN PATENT DOCUMENTS

| | | | |
|---|---|---|---|
| WO | 9517331 | A1 | 6/1995 |
| WO | 9715489 | A1 | 5/1997 |
| WO | 9719849 | A1 | 6/1997 |
| WO | 2015055210 | A1 | 4/2015 |

* cited by examiner

FOLDING PROPELLER

This application claims the benefit of Danish Application No. PA 2016 70089 filed Feb. 18, 2016 and PCT/DK2016/050294 filed Sep. 7, 2016, International Publication No. WO 2017/140314 A1, which are hereby incorporated by reference in their entirety as if fully set forth herein.

FIELD OF THE INVENTION

The present invention relates to a folding propeller for a boat, e.g. for a sailboat or a multihull yacht, where said folding propeller comprises a hub for directly or indirectly fastening at a driveshaft connected to a motor, where said folding propeller further comprises at least three individual blades, where each of said blades comprises a blade root arranged to pivot around a separate pivot pin, at said hub in order to be either in a first and operative position, where the blade is pointing mainly in a radial direction, or in a second and inoperative position, where the blade is pointing mainly in an axial direction, where said pivot pin comprises a first and second end, where said hub comprises a cut out for each of said blade roots, and further comprises a set of holes for installing said pivot pins.

BACKGROUND OF THE INVENTION

It is well known that boats such as sailboats and multihull yachts use folding propellers in order to minimise drag, noise and wear when sailing without use of the auxiliary propelling means—a motor. Using a folding propeller will prevent that the propeller is rotated by the water and creates drag and noise when sailing and not using the motor, but further there is much less tendency for the propeller to get tangled up in fishing lines, rope and other articles that otherwise would accumulate on the propeller.

Another rather important issue when it comes to propellers for boats is corrosion and effectiveness. Galvanic corrosion can be limited by using sacrificial anodes that will be corroded instead of the propeller hub and blades. Another important subject is the effectiveness of the propeller, which can be compromised rather drastically due to fouling on the propeller parts. Until now the design of folding propellers did not address the problem with fouling very well.

DK 178074 B1 describes a folding blade propeller, comprising three blades, where the folding propeller is rather corrosion resistant, has a low moment of inertia, and where slack between the individual parts of the folding propeller can be adjusted according to production tolerances and to wear. Further a folding propeller is described, where the mechanism for taking up the forces acting on the propeller when operated, comprises a closed mechanical system allowing for the use of a low tensile strength material for parts of the propeller.

U.S. Pat. No. 5,403,217 describes another folding blade propeller for a power vessel, wherein the folding blade propeller comprises a hub for directly or indirectly mounting on a driving shaft, where the folding blade propeller further comprises at least two propeller blades, where each of the propeller blades comprises a base arranged to turn around each own pivot pin at the mentioned hub for in that way to be in either a first operative position, where the propeller blades are pointing in a mainly radial direction, or to be in another and inoperative position, where the propeller blades are pointing in a mainly axial direction, and where the mentioned hub comprises one or several cut outs for the mentioned bases and a first set of holes for inserting of the mentioned pivot pins.

OBJECT OF THE INVENTION

It is an object of the invention to provide an effective and robust folding propeller that is corrosion resistant, has a low moment of inertia, and where the individual parts of the folding propeller are strongly linked together via a mechanism, where the mentioned mechanism is arranged for taking up the forces acting on the propeller when operated, and comprises a closed mechanical system allowing for the use of a low tensile strength material for specific parts of the propeller.

DESCRIPTION OF THE INVENTION

As mentioned above, the invention relates to a folding propeller for a boat, e.g. for a sailboat or a multihull yacht, where said folding propeller comprises a hub for directly or indirectly fastening at a driveshaft connected to a motor, where said folding propeller further comprises at least three individual blades, where each of said blades comprises a blade root arranged to pivot around a separate pivot pin, at said hub in order to be either in a first and operative position, where the blade is pointing mainly in a radial direction, or in a second and inoperative position, where the blade is pointing mainly in an axial direction, where said pivot pin comprises a first and second end, where said hub comprises a cut out for each of said blade roots, and further comprises a set of holes for installing said pivot pins.

The new and inventive folding propeller is characterised in, that each of the holes in said set of holes for installing the pivot pins may be interconnected with an adjacent hole for installation of a separate pivot pin, where two adjacent holes at one end are arranged in a common aperture, called a lockbox seat, where said lockbox seat serves as installation opening for two adjacent pivot pins, where the two adjacent installed pivot pins at the respective ends comprise means for engagement with a common lockbox.

The pivot pins—one for each propeller blade—are held together in a triangular shape with three lockboxes that locks two adjacent pivot pins from being separated, and thus forms a closed structure that holds the propeller blades at the blade roots of the propeller. The pivot pins may also be held in a square (quadrilateral) shape with four lockboxes that locks two adjacent pivot pins from being separated. The hub itself then has a less important role, as the reactions from the centrifugal forces, when the propeller is driven, will mainly be taken up by said closed structure of the pivot pins and the lockboxes and thus the hub is spared from said reactions. The pivot pins are, as mentioned, arranged in a triangular or square shape and at the corners the structure is closed by a lockbox arranged in a manner that covers/holds the ends of two pivot pins.

A folding propeller as described having three blades will typically have blades manufactured from a metal alloy comprising Ni, Al, Cu, bronze and/or other copper and stainless steel alloys that will be suitable for this purpose.

During installation of a folding propeller, according to the invention, the propeller will be disassembled more or less completely. The hub, the propeller blades and the pivot pins and the lockboxes will be separated in order to install the hub at the driveshaft of the boat. After having installed the hub and secured it in position, the first propeller blade is arranged and aligned with the root in the cut out in the hub and the first pivot pin is inserted in the hole in the hub and through the root of the blade and into the other side of the hub. After having installed the first propeller blade, the second propeller blade is arranged and aligned with the root in the cut out in the hub and the second pivot pin is inserted as the first, and in the same manner the third and/or fourth propeller blade, and the third and/or fourth pivot pin is installed.

After having inserted the first, second and third pivot pin in the respective holes it is time to install the three or four locking means i.e. one lockbox that covers the ends of each of two adjacent pivot pins. The lockboxes may be fastened directly or indirectly to the pivot pins and/or to the hub of the propeller. The arrangement may thus comprises three pivot pins, namely a first, a second and a third pivot pin, and further the arrangement comprises a first, a second and a third lockbox, where the first and second pivot pin, when installed, are held together at their adjacent ends by a first lockbox. In the same manner the second and third pivot pin are held together at their adjacent ends by a second lockbox and the third and first pivot pin are held together at their adjacent ends by a third lockbox. Examples of embodiments will be given below.

In an embodiment of a folding propeller, according to the invention, said hub can be manufactured from a plastic material, e.g. POM, PET, PA, from a fibre reinforced polymer material and/or from another material having similar properties, where POM means polyacetal, PET means polyethylene terephthalate and PA means polyamide.

Fibre reinforced polymer material should be understood as a general term comprising any type of fibres such as fibres made from glass, carbon, hybrids thereof, synthetic fibres, metal fibres or any other type of reinforcing fibres or materials. Other types of polymers and thermosetting materials with suitable properties may also be used for said hub. The mentioned properties of said materials can e.g. be mechanical, electrical and/or chemical, where a material for a specific use is chosen according to specific and relevant properties.

A hub made from plastics has the advantage of being an electrical insulator preventing or at least minimising corrosion of the metal parts of the hub. Further plastic is a cheap material that is easy to machine and strong enough to transfer the torque of the motor. A hub made from a polymer also has a considerably lower weight and thus also less inertia when rotating and especially when changing between forward and reverse rotation of the propeller, which is one of the situations where the prior art folding propellers experience a high load due to a relatively high weight of the hub itself.

In an embodiment of a folding propeller, according to the invention, said hub can be manufactured from a metal alloy, e.g. bronze, stainless steel or another suitable metal alloy.

The material used for the hub can in principle be any suitable material, metallic or not and no matter if the hub is made from a polymer or from a metal alloy one or more anodes can be arranged at the hub in order to protect against galvanic corrosion on the parts of the folding propeller.

In yet an embodiment of a folding propeller, according to the invention, the lockbox comprises fixating means, where said fixating means are arranged for engagement with at least one of: a lockbox seat, the ends of two adjacent pivot pins, a cross dowel arranged in inside of a vertex of the regular triangle shaped by the pivot pins when installed.

Cross dowels—one in each vertex of the regular triangle or square—may be oriented mainly in parallel with the rotational axis of the hub. Fixating means may be one of: threads on the outside of the lockbox for engaging threads in the lockbox seat, threads on the inside of the lockbox for engaging threads at the ends of two adjacent pivot pins, threads in the cross dowel for engaging a locking screw installed in a hole in the lockbox and/or a combination of one of the thread solutions and the cross dowel solution.

In order for the mentioned cross dowels to be installed, the hub comprises holes arranged axially to the rotational axis of the hub, perpendicular to the holes for the pivot pins, and on the inside of each vertex of the regular triangle or square shaped by the pivot pins when installed. The lockbox comprises a hole in the centre, pointing in a direction towards the middle of the closed triangular or square structure, and the mentioned locking screw will be installed in the lockbox and will engage the threaded hole in said cross dowel and thus lock the lockbox and the pivot pins to the hub.

A folding propeller, according to the invention, may also comprise a lockbox comprising at least one flange, where said at least one flange comprises a hole for engagement with at least one of: a cross dowel and a bolt arranged in parallel with the rotational axis of the hub at the inside of a vertex of the regular triangle or square shaped by the pivot pins when installed.

As mentioned above the hub may comprise a galvanic anode, which may be installed at a hub end cap using a suitable fastening means, e.g. a bolt that engages a threaded hole in said hub end cap. The hub end cap may be installed at the end of the hub using bolts that engage threaded holes in the hub. Such bolts may at the same time engage the above mentioned flanges at the lockboxes and thus hold the respective parts in a solid position. The hub end cap may also be fastened with bolts that engage threaded holes at the ends of the cross dowels arranged in the vertex of the regular triangle or square. This way the cross dowels have two functions: first to support and secure the lockboxes and the pivot pins and second to serve as a mounting interface for the hub end cap.

Yet another advantage of the hub end plate carrying a galvanic anode is that the hub end plate and the cross dowels or bolts act as electrical connecting members that allow the galvanic anode to work and protect the metal parts of the hub and especially the blades and the blade roots from galvanic corrosion.

On the lower side (the side facing the hub) of the hub end cap there may be arranged a recess at each hole, where each recess is suitable for receiving the end of a cross dowel. This way the cross dowels are supported in a radial direction by the hub end cap and thus the hub end cap becomes a part of the structural arrangement and contributes in transferring the loads acting on the folding propeller when in use. The mentioned recess is however not necessary and a hub end cap can be designed with or without such recesses.

The pivot pins may be shaped at the ends—when arranged in a closed regular triangular or squared position at the hub—for receiving the inner surface or surfaces of a lockbox. The lock box may thus have a shape e.g. an internal cylindrical shape, which will encircle the ends of two adjacent pivot pins as such. The lockbox may be fastened to the hub in any suitable manner. The fastening between the lockbox and the pivot pins or the lockbox seat at the hub may be done using one or more of several suitable fastening means. It can e.g. be done using external threads at the pivot pins adapted for a mating thread in the lockbox. The lock box may comprise a through hole in the end pointing in a direction towards the middle of the closed triangular or square structure for receiving a locking screw, where the locking screw engages either the hub or a cross dowel at the hub.

The ends of the pivot pins may comprise a threaded or non-threaded hole pointing in a direction towards the middle of the closed triangular or square structure—when installed. The ends of the pivot pins may be identical or they may be different in design, but shaped to complement each other.

In order to secure said locking means, e.g. a lockbox, a locking screw or other parts, in position, the fasteners/locking means can be secured with thread-locking adhesive and/or by engaging narrow holes in the hub, where said narrow holes when entered will press against the threads and possibly deform the threads and thus lock the threads.

A folding propeller, according to the invention, may have one or more lockboxes comprising a central and frustoconical hole, where said central and frustoconical hole is arranged to engage a mating frustoconical surface of the ends of two adjacent pivot pins. This way the lockbox may be used to squeeze the ends of the pivot pins together into a proper and tight position. The squeeze effect may be obtained by installing a locking screw as described above and as will be seen in the drawings.

In a variant of a folding propeller, according to the invention, said central and frustoconical hole may comprise an internal thread, where said mating frustoconical surface of the ends of two adjacent pivot pins comprises an external thread. This will allow the lockbox to be screwed onto the ends of the pivot pins and thus obtain a proper and tight assembly.

In another variant of a folding propeller, according to the invention, said lockbox may comprise an outer frustoconical surface, where said outer frustoconical surface is arranged to engage a mating frustoconical surface in said lockbox seat. Again this will allow the lockbox and the rest of the structure to obtain a proper and tight assembly.

The mentioned outer frustoconical surface may comprise an external thread, where said mating frustoconical surface in said lockbox seat comprises an internal thread. This will allow the lockbox to be screwed into the lockbox seat in the hub and thus to hold the ends of the pivot pins and to obtain a proper and tight assembly.

Yet another embodiment of a folding propeller, according to the invention, comprises, at the hub, at least one connecting link, where said at least one connecting link comprises means for interacting with at least two of said pivot pins.

Such a connecting link can be compared to the side plate of a roller chain, where the connecting link has openings for receiving the pivot pins and thus supports the lockboxes and the hub, which holds the pivot pins in place during operation. The connecting link is actually a kind of safety strap helping the lockboxes to hold the pivot pins and also to relieve the load on the hub. Thus, the hub can—if preferred—be manufactured from a less strong and solid material such as the known metal alloys and instead be manufactured from a polymer as mentioned above. Such a connecting link can be arranged in a manner that allows for an anode to be installed to the connecting link using high corrosion resistant bolts.

A connecting link may be arranged at each side of a blade root and shaped so as to fit in two adjacent cut outs for the blade roots and thus be connecting e.g. the first and second pivot pin and so on. Such a connecting link may be embedded in the material of the hub or it may be separate parts. Another design of such a connecting link may comprise at least three radially extending link arms, shaped to fit in a slot at each of the blade roots as will be seen in a figure below.

In an attractive variant of a folding propeller, according to the invention, said folding propeller may comprise at least three individual blades, each blade having a blade root comprising a gear engaging one or more other gears at other blade roots.

Using gears at the blade root of the propeller blades secures a simultaneous engagement of all propeller blades when engaging the drive shaft. The propeller blades are forced into the operative position by the centrifugal forces, and by using the gears it is secured that all blades will be activated in an equal manner and thus the system—the folding propeller—will be in an optimum balance. A folding propeller, according to the invention, may however be designed with blades without such a gear.

If the folding propeller has been in service for some time, a routine service may be performed by loosening the lockboxes and the pivot pins, cleaning their locking means, threads or perhaps replacing all or some of the parts before refitting the folding propeller. Such a service can for instance be carried out during winter time where the boat is taken out of the water however; it is also possible to perform such a service while the boat is in the water.

DESCRIPTION OF THE DRAWING

An embodiment of the invention will now be described, by way of example only, with reference to the accompanying drawings, in which.

Figure 1:
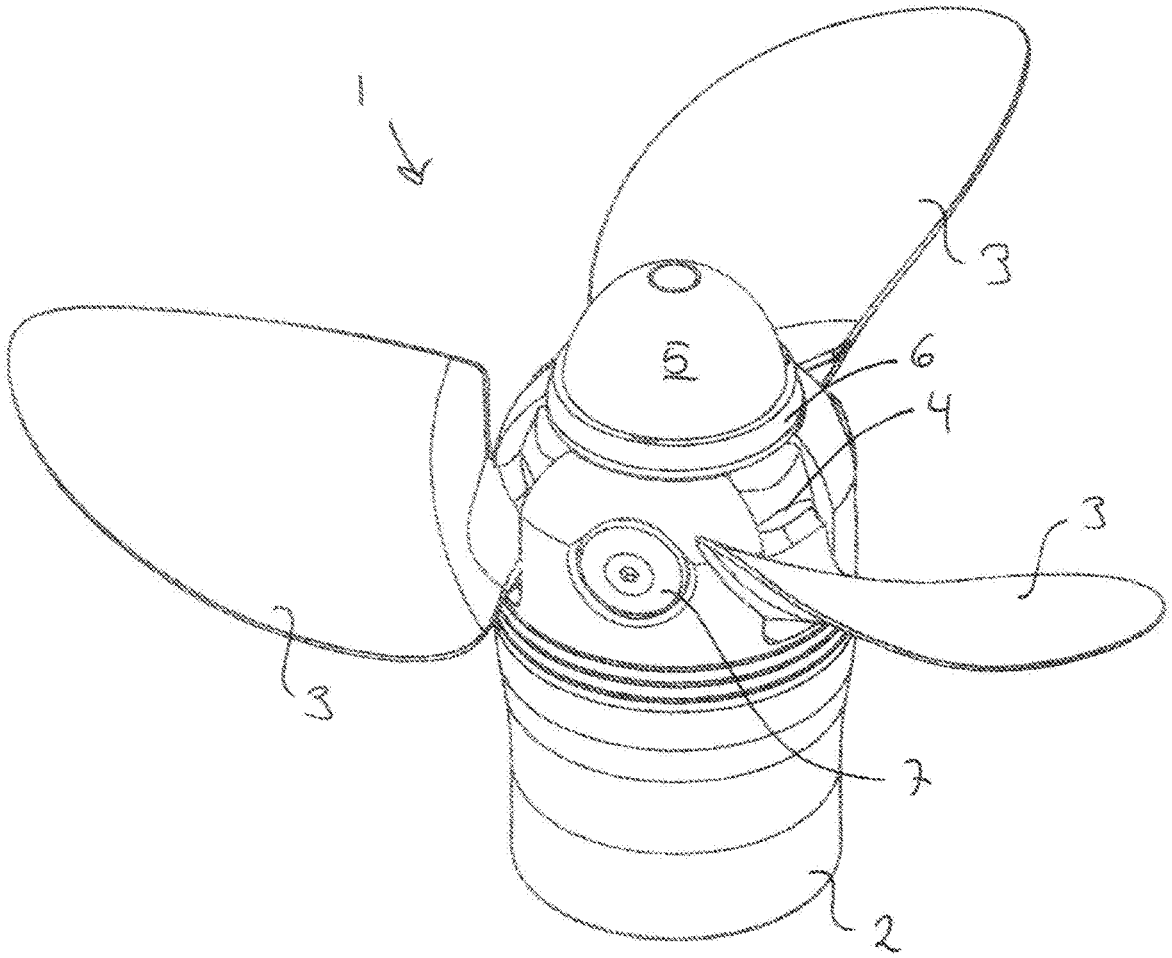
FIG. 1 shows a three bladed folding propeller in an operative position.

In the following text, the figures will be described one by one and the different parts and positions seen in the figures will be numbered with the same numbers in the different figures. Not all parts and positions indicated in a specific figure will necessarily be discussed together with that figure.

POSITION NUMBER LIST

1. Folding propeller
2. Hub
3. Blade
4. Blade root
5. Anode

6. Hub end cap
7. Lockbox
8. Gear at blade root
9. Pivot pin
10. Hole in hub for pivot pin
11. Vertex of the "pivot pin triangle"
12. Cross dowel
13. Threaded hole in cross dowel
14. Locking screw
15. Hole for cross dowel
16. Lockbox seat/common aperture
17. Hole in lockbox flange
18. Flange at lockbox
19. Cut out in hub for propeller blade roots
20. First end of pivot pin
21. Second end of pivot pin
22. Engagement means at pivot pins
23. Surface at pivot pin ends
24. Internal surface of lockbox
25. Central hole in lockbox
26. Threads
27. Hole in end of pivot pin
28. Angle
29. Outer surface on lockbox
30. Surface in lockbox seat
31. Bolt
32. Side link
33. Holes in the link for the pivot pins
34. Triple link

DETAILED DESCRIPTION OF THE INVENTION

In FIG. 1 a three bladed folding propeller 1 is seen in an operative position, where the hub 2 holds the blades 3 in an unfolded position and extending in a more or less radial direction from the hub 2. The blades 3 are fastened to the hub 2 at the blade roots 8, and at the end of the hub 2 an anode 5 is seen at a hub end cap 6. On the side of the hub 2 a lockbox 7 is seen installed.

Figure 2:
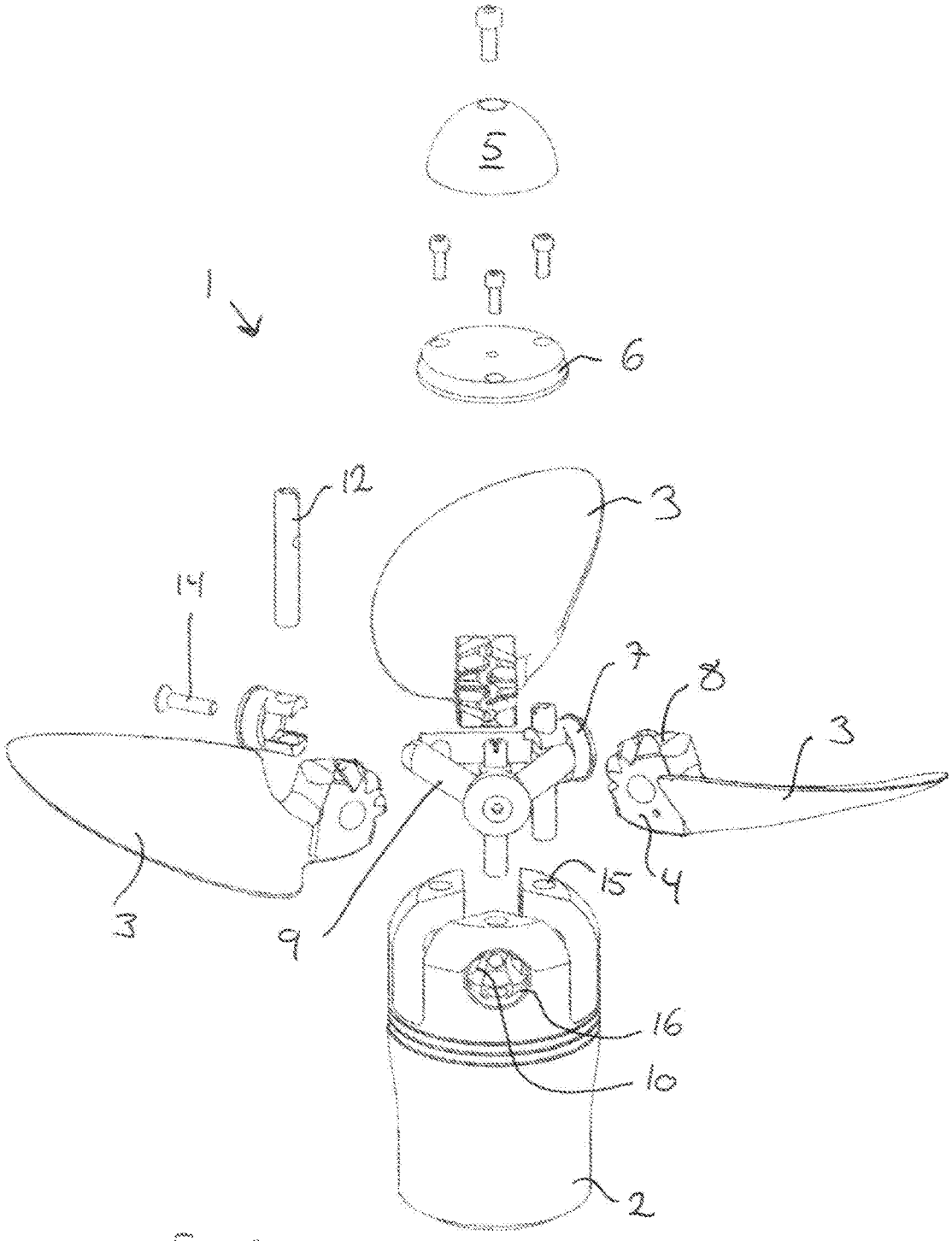
FIG. 2 shows a three bladed folding propeller disassembled.

FIG. 2 shows the same three bladed folding propeller 1 as seen in FIG. 1, but here seen in a disassembled state. In this figure the gears 8 at the blade roots 4 are seen, which will secure that all three blades 3 will engage in synchrony. Further the pivot pins 9 are seen in a triangular structure and the holes 10 in the hub 2 for the pivot pins 9 are also seen. At the vertex 11 of the "pivot pin triangle" a cross dowel 12 is seen having a threaded hole 13 for a locking screw 14. The locking screw 14 will be inserted through a central hole in the lockbox 7 and the cross dowel will be installed in a mating hole 15 at the hub 2.

The pivot pins 9 will be installed in the holes 10 through the lockbox seat 16 (common aperture). The cross dowels 12 will be installed at the hub 2 and through holes 17 in flanges 18 at the lockboxes 7, which will secure the triangular pivot pin structure and the blade roots 4 in the cut outs 19 in the hub 2 in a very solid manner.

The anode 5 is installed at the hub end cap 6 using a bolt that engages a threaded hole in said hub end cap. The hub end cap 6 is installed at the hub 2 using bolts that engage threaded holes at the ends of the cross dowels 12. On the lower side of the hub end cap 6 a recess at each hole is arranged, where each recess is suitable for receiving the end of a cross dowel 12. This way the cross dowels 12 are supported by the hub end cap 6 and the hub end cap 6 becomes a part of the structural arrangement and contributes in transferring the loads acting on the folding propeller 1 when in use.

Figure 3:
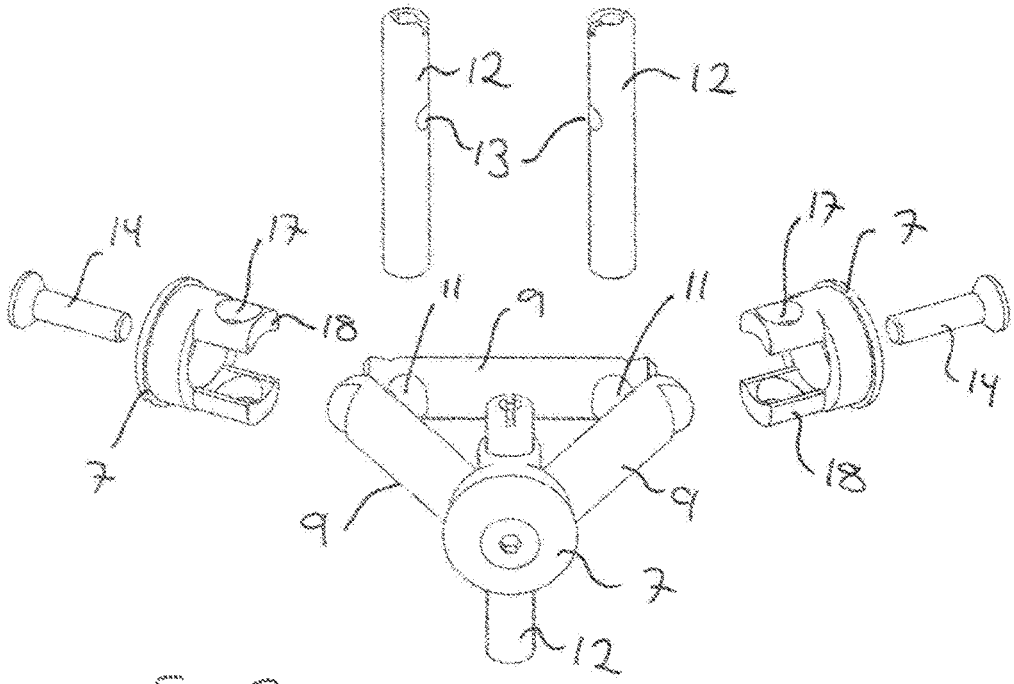
FIG. 3 shows three pivot pins arranged in a triangle in a first configuration.

FIG. 3 shows the same triangular pivot pin structure as seen in FIG. 2 and still in a partly assembled state. The pivot pins 7 are seen having their respective first ends 20 and second ends 21 arranged in a triangular shape, where two pivot pins ends 20, 21 are arranged adjacent each other. The respective ends 20, 21 are shaped with engagement means 22 for engagement with a lockbox 7.

Figure 4:
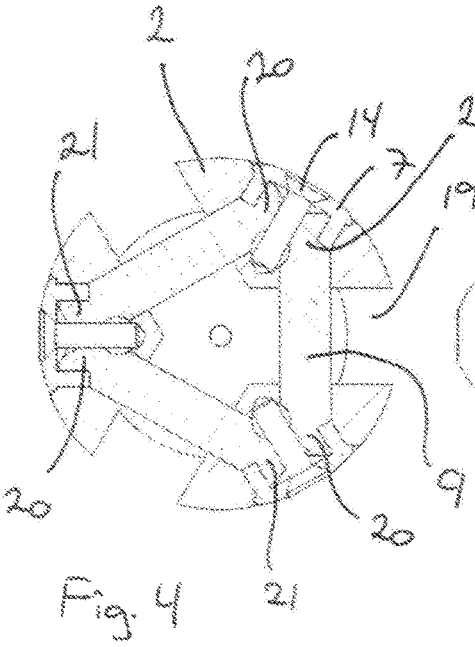
FIG. 4 shows a cross sectional view of a hub.

FIG. 4 shows a cross sectional view of a hub 2, where pivot pins 9 are arranged in holes 10 in the hub 2. Cross dowels 12 are installed at the vertex 11 of the triangle and the lockboxes 7 are held in place in the lockbox seats 16 by locking screws 14. Here it is seen that the lockboxes 7 engage the respective ends 20, 21 of two adjacent pivot pins 9 and thus hold the triangular structure in a fixed position.

Figure 5:
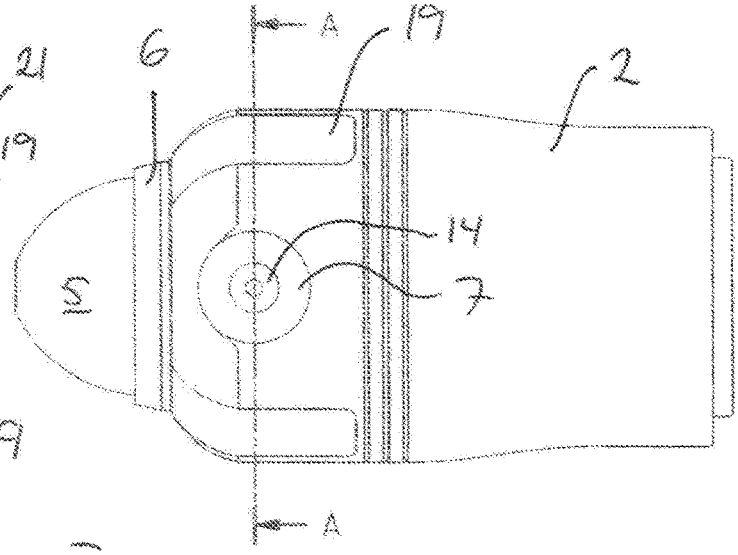
FIG. 5 shows a side view of the hub seen in FIG. 4.

FIG. 5 shows a side view of the hub seen in FIG. 4 and indicates a view line A-A with reference to FIG. 4.

Figure 6:
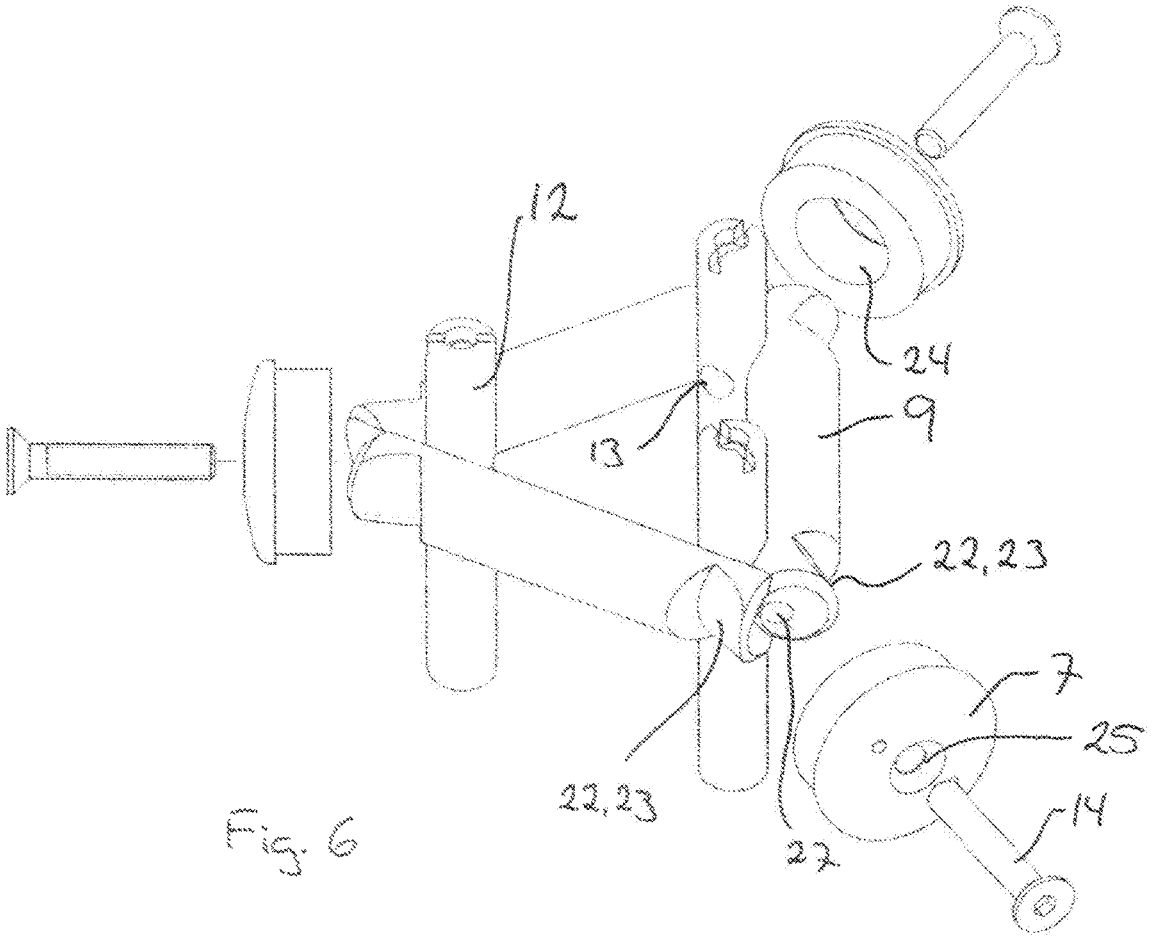
FIG. 6 shows three pivot pins arranged in a triangle in a second configuration.

In FIG. 6 three pivot pins 9 are arranged in a triangle in a second configuration, where the first end 20 and the second end 21 of the pivot pins 9 are designed differently, but where two adjacent ends 20, 21 altogether constitute engagement means 22 having a mating surface 23 for the internal surface 24 of a lockbox 7. The mentioned surfaces 23, 24 may be cylindrical or frustoconical and they may comprise mating threads 26 or they may be smooth surfaces. In this configuration the lockboxes 7 comprise a central hole 25 for a locking screw 14, where the locking screw 14 via a hole 27 in one or two adjacent pivot pin ends 20, 21 is fastened in a threaded hole 13 in a cross dowel 12.

Figure 7:
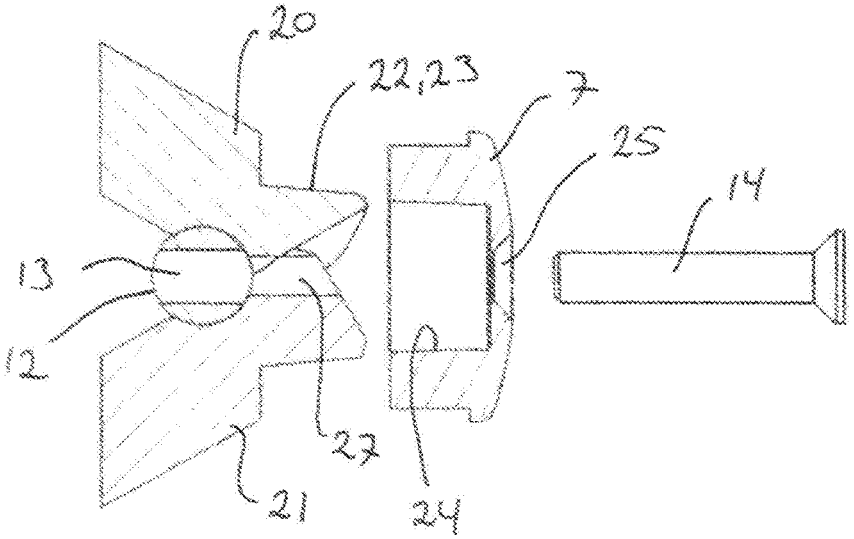
FIG. 7 shows a cross sectional view of two pivot pins and a lockbox as seen in FIG. 5.

FIG. 7 shows a cross sectional view of the assembly as described above, where two pivot pins 9, a lockbox 7, a cross dowel 12 and a locking screw 14 is seen.

Figure 8:
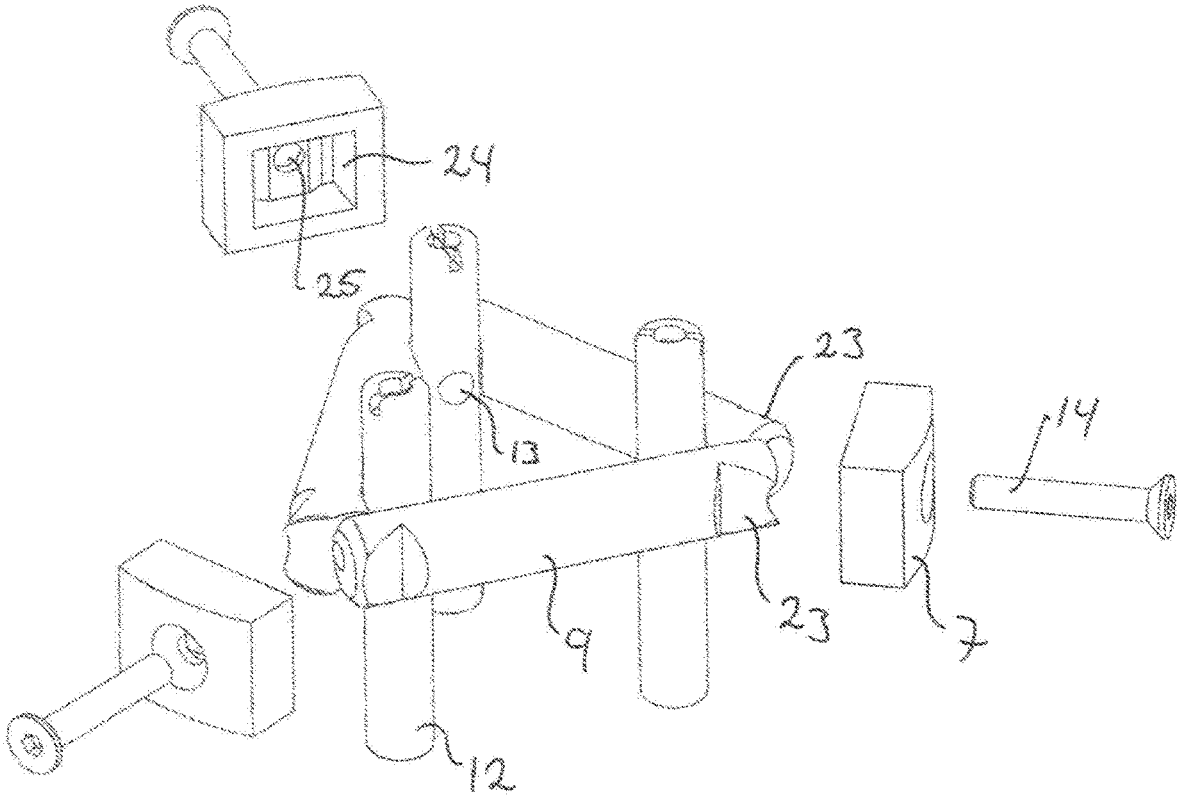
FIG. 8 shows three pivot pins arranged in a triangle in a third configuration.

FIG. 8 shows three pivot pins 9 arranged in a triangle in a third configuration, more or less as also seen in FIG. 6 and in FIG. 7. The main difference is that the lockboxes 7 are rectangular and with conical/wedge shaped internal surfaces 24 shaped to mate the likewise conical/wedge shaped surface at the respective ends 20, 21 of the pivot pins 9. A locking screw 14 will secure the lockboxes 7 in place when installed.

Figure 9:
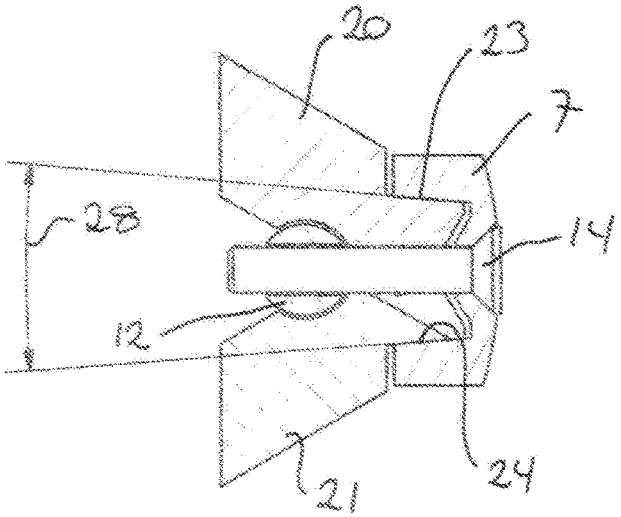
FIG. 9 shows a cross sectional view of two pivot pins and a lockbox as seen in FIG. 7.

FIG. 9 shows a cross sectional view of the configuration seen in FIG. 8, where two pivot pins 9, a lockbox 7, a cross dowel 12 and a locking screw 14 are seen. Further the angle 28 of the conical/wedge shaped surfaces 23, 24 is illustrated.

Figure 10:
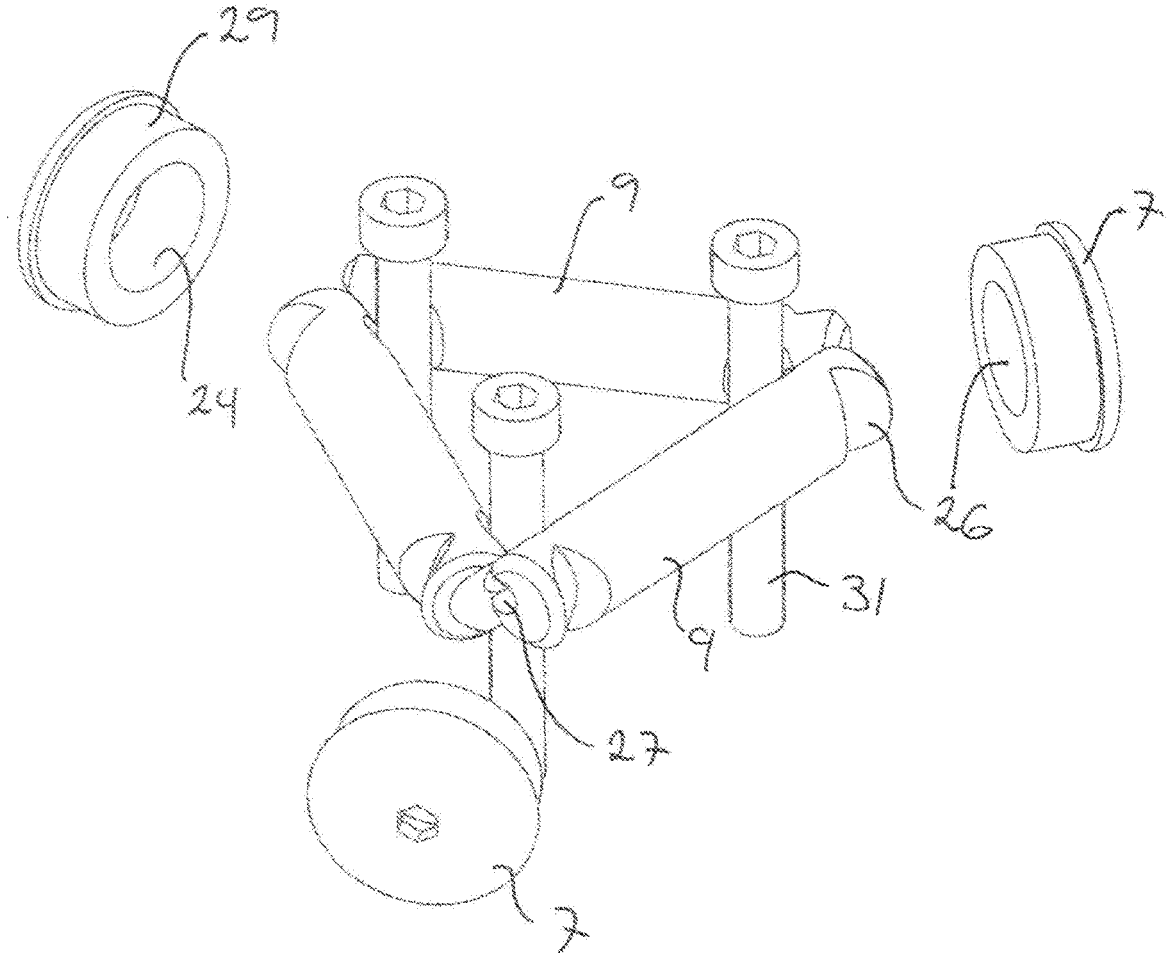
FIG. 10 shows three pivot pins arranged in a triangle in a fourth configuration.

In FIG. 10 three pivot pins 9 are arranged in a triangle in a fourth configuration, where the lockboxes 7 comprise an internal surface 24, which surface may or may not comprise threads 26 for engaging mating threads 26 at the surface 23 of the pivot pin 9 ends 20, 21. The lockboxes 8 may or may not comprise threads 26 at the outer surface 29 of the lockbox 7. Said threads 26, if present, are designed to engage a mating thread 26 at the respective surfaces 30 of the lockbox seats. This type of lockbox 7 is designed to be installed by being screwed onto the ends 20, 21 of the pivot pins 9 or into the lockbox seat 16 by a suitable tool e.g. a hex key. In this configuration there are no cross dowels 12, but instead three bolts 31 are arranged—one in each vertex 11 of the pivot pin triangle. The bolts 31 serve as support for the pivot pins 9, but also as fasteners for the hub end cap 6 as seen in FIGS. 1, 2 and 4.

Figure 11:
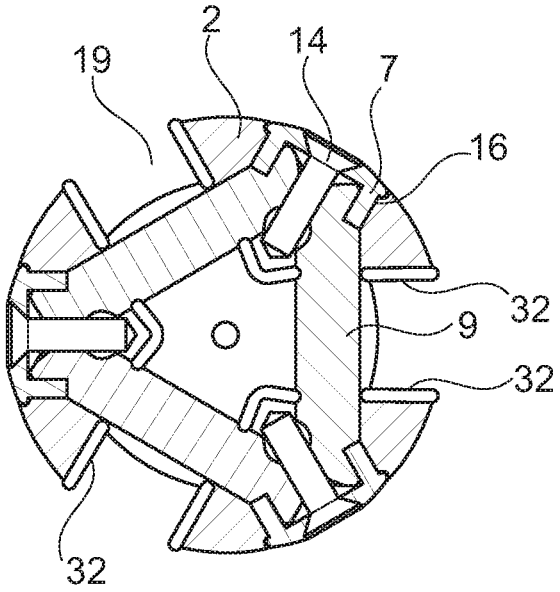
FIG. 11 shows a cross sectional drawing of a hub and pivot pins for a three bladed folding propeller, with side links.

In FIG. 11 a cross sectional drawing of a hub 2 is seen having pivot pins 9 for a three bladed folding propeller 1 and with side links 32. Side links 32 act as reinforcement and hold the pivot pins 9 in the correct position when forces are acting during rotation of the folding propeller 1. The side links 32 are made from steel or another suitable material and they may be embedded in the hub material or they may be installed as a kind of bearing material between the blade root 4 and the hub 2.

Figure 12:
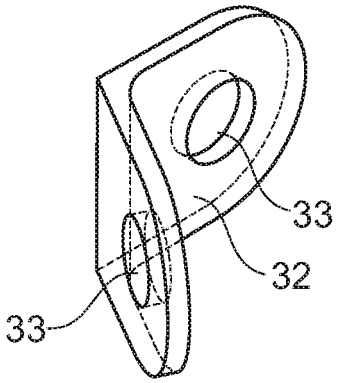
FIG. 12 shows a side link.

FIG. 12 shows a side link 32 as mentioned above, where holes 33 for the pivot pins 9 are seen clearly.

Figure 13:
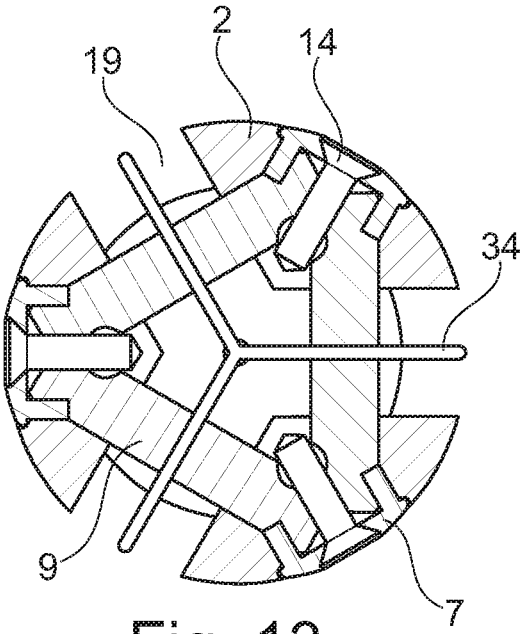
FIG. 13 shows a cross sectional drawing of a hub and pivot pins for a three bladed folding propeller, with a triple link.

FIG. 13 shows a cross sectional drawing of a hub 2 and pivot pins 9 for a three bladed folding propeller 1, with a triple link 34. The triple link 34 acts as the side link 32 seen in FIGS. 12 and 13, but is connected to all three pivot pins 9. The blade roots 4 will need to have a central dividing slit in order to accommodate the legs of the triple link 34. The side link 32 may also be arranged as a three part triple link in the same manner as seen in FIG. 14 but where three individual side links 32 are arranged centrally at the hub 2.

Figure 14:
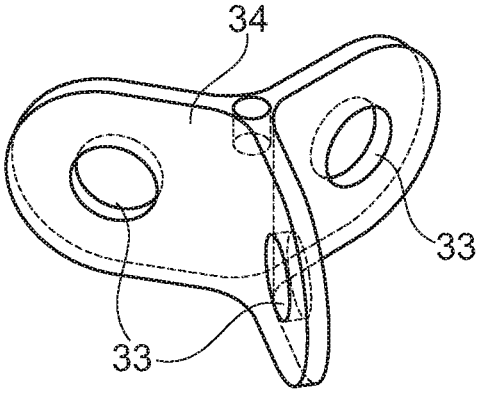
FIG. 14 shows a triple link.

FIG. 14 shows a triple link 34 as mentioned above, where holes 33 for the pivot pins 9 are seen clearly.

The invention is not limited to the embodiments described herein, and may be modified or adapted without departing from the scope of the present invention as described in the patent claims below.

The invention claimed is:

1. A folding propeller for a boat, where said folding propeller comprises a hub for directly or indirectly fastening at a driveshaft connected to a motor, where said folding propeller further comprises at least three individual blades, where each of said at least three individual blades comprises a blade root arranged to pivot around a separate pivot pin, at said hub in order to be either in a first and operative position, where each of said at least three individual blades is pointing mainly in a radial direction, or in a second and inoperative position, where each of said at least three individual blades is pointing mainly in an axial direction, where said pivot pin comprises a first and second end, where said hub comprises a cut out for each of said blade roots, and further comprises a set of holes for installing said pivot pins, where each of the holes in said set of holes for installing the pivot pins are inter-connected with an adjacent hole for installation of a separate pivot pin, where two adjacent holes at one end are arranged in a common aperture, called a lockbox seat, where said lockbox seat serves as installation opening for two adjacent pivot pins, wherein the two adjacent installed pivot pins at the respective ends engage with a common lockbox.

2. The folding propeller according to claim 1, wherein said hub is manufactured from a plastic material.

3. The folding propeller according to claim 1, wherein said hub is manufactured from a metal alloy.

4. The folding propeller according to claim 1, wherein said lockbox comprises engagers, where said engagers are arranged for engagement with at least one of: a lockbox seat, the ends of two adjacent pivot pins, a cross dowel arranged inside of a vertex of the regular triangle or square shaped by the pivot pins when installed.

5. The folding propeller according to claim 1, wherein said lockbox comprises at least one flange, where said at least one flange comprises a hole for engagement with at least one of: a cross dowel and a bolt arranged in parallel with the rotational axis of the hub at the inside of a vertex of the regular triangle or square shaped by the pivot pins when installed.

6. The folding propeller according to claim 1, wherein said lockbox comprises a central and frustoconical hole, where said central and frustoconical hole is arranged to engage a mating frustoconical surface of the ends of two adjacent pivot pins.

7. The folding propeller according to claim 6, wherein said central and frustoconical hole in said lockbox comprises an internal thread, and where said mating frustoconical surface of the ends of two adjacent pivot pins comprises an external thread.

8. The folding propeller according to claim 1, wherein said lockbox comprises an outer frustoconical surface, where said outer frustoconical surface is arranged to engage a mating frustoconical surface in said lockbox seat.

9. The folding propeller according to claim 8, wherein said outer frustoconical surface comprises an external thread, and where said mating frustoconical surface in said lockbox seat comprises an internal thread.

10. The folding propeller according to claim 1, wherein said folding propeller comprises at least one connecting link, where said at least one connecting link comprises holes for interacting with at least two of said pivot pins.

11. The folding propeller according to claim 1, wherein said folding propeller comprises at least three individual blades, each blade having a blade root comprising a gear engaging one or more other gears at other blade roots.

12. The folding propeller according to claim 2, wherein the plastic material is POM, PET, PA, and/or from a fibre reinforced polymer material.

13. The folding propeller according to claim 3, wherein the metal alloy is bronze or stainless steel.

* * * * *